US008616036B2

(12) United States Patent
Jaubert et al.

(10) Patent No.: US 8,616,036 B2
(45) Date of Patent: Dec. 31, 2013

(54) MACHINE FOR BENDING A PROFILE IN TWO BENDING DIRECTIONS AND BENDING TOOL

(75) Inventors: Philippe Jaubert, Cologne (FR); Nicolas Dunand, Saint Clar (FR)

(73) Assignee: Eaton Leonard Europe, Cologne (FR)

( * ) Notice: Subject to any disclaimer, the term of this patent is extended or adjusted under 35 U.S.C. 154(b) by 816 days.

(21) Appl. No.: 12/682,884

(22) PCT Filed: Oct. 14, 2008

(86) PCT No.: PCT/FR2008/001436

§ 371 (c)(1),
(2), (4) Date: Apr. 13, 2010

(87) PCT Pub. No.: WO2009/087297

PCT Pub. Date: Jul. 16, 2009

(65) Prior Publication Data

US 2010/0223971 A1 Sep. 9, 2010

(30) Foreign Application Priority Data

Oct. 15, 2007 (FR) ..... 07 07206

(51) Int. Cl.
*B21D 7/04* (2006.01)

(52) U.S. Cl.
USPC ..... 72/149; 72/153

(58) Field of Classification Search
USPC ..... 72/149, 159, 386, 389.1, 153, 155, 156, 72/31.04, 31.05, 369
See application file for complete search history.

(56) References Cited

U.S. PATENT DOCUMENTS

| | | | | | |
|---|---|---|---|---|---|
| 4,232,813 | A * | 11/1980 | Eaton | 228/147 |
| 4,485,658 | A * | 12/1984 | Stewart et al. | 72/149 |
| 4,563,891 | A * | 1/1986 | Schwarze | 72/149 |
| 4,581,917 | A * | 4/1986 | Moriyama et al. | 483/29 |
| 4,658,624 | A * | 4/1987 | Ridgway et al. | 72/316 |
| 5,461,893 | A * | 10/1995 | Tyler | 72/16.2 |
| 5,495,740 | A * | 3/1996 | Schwarze | 72/149 |
| 6,134,932 | A * | 10/2000 | Marque et al. | 72/149 |
| 6,185,969 | B1 * | 2/2001 | Jaubert | 72/175 |
| 6,192,728 | B1 * | 2/2001 | Hu | 72/149 |
| 7,234,333 | B2 * | 6/2007 | Maier et al. | 72/156 |

(Continued)

FOREIGN PATENT DOCUMENTS

| | | |
|---|---|---|
| EP | 2117745 A | 7/1972 |
| EP | 0108193 A | 5/1984 |

(Continued)

*Primary Examiner* — Debra Sullivan
(74) *Attorney, Agent, or Firm* — Birch, Stewart, Kolasch & Birch, LLP

(57) ABSTRACT

The invention relates to a machine for bending a profile in two bending directions, that comprises a bending tool including at least two clamping forms (19) centered on the profile bending axis and having the shape of disks having planar junction surfaces (19*a*) extending in planes perpendicular to said bending axis, in which are formed two rectilinear grooves (20*b*, 21*b*) and a peripheral rebate (22*b*) extending between said grooves and profiled as a continuation thereof, the grooves and the rebate being adapted so that, in the joined position of the junction surfaces (19*a*) of two clamping foams, the joined grooves define two clamping ducts of a profile and the joined rebates define a profile-winding bearing surface extending between said clamping ducts.

16 Claims, 8 Drawing Sheets

(56) References Cited

U.S. PATENT DOCUMENTS

| | | | | |
|---|---|---|---|---|
| 7,254,972 | B1 * | 8/2007 | Wang | 72/157 |
| 7,360,385 | B1 * | 4/2008 | Wohlenhaus et al. | 72/150 |
| 2004/0200253 | A1 * | 10/2004 | Schmauder et al. | 72/149 |
| 2005/0172690 | A1 * | 8/2005 | Cappello et al. | 72/149 |
| 2005/0241356 | A1 * | 11/2005 | Yogo | 72/149 |
| 2006/0027008 | A1 * | 2/2006 | Caporusso | 72/149 |
| 2007/0246899 | A1 * | 10/2007 | Haimer | 279/9.1 |
| 2008/0236234 | A1 * | 10/2008 | Rusch | 72/149 |

FOREIGN PATENT DOCUMENTS

| | | | |
|---|---|---|---|
| EP | 0737526 | A | 10/1996 |
| EP | 1561522 | A | 8/2005 |
| EP | 1591174 | A | 11/2005 |
| FR | 2117745 | A | 7/1972 |

* cited by examiner

MACHINE FOR BENDING A PROFILE IN TWO BENDING DIRECTIONS AND BENDING TOOL

FIELD OF THE INVENTION

The invention concerns a machine for bending a profile in two bending directions and is also directed to a bending tool for such a bending machine.

DESCRIPTION OF RELATED ART

At present standard bending machines comprise means for holding profiles and moving them along a longitudinal axis (x) and a bending head rotatable about a bending axis (z), said bending head including as standard a bending roller and a clamping jaw having bearing surfaces between which a profile to be bent passes, is clamped and then bent:

the bending roller axis coinciding with the bending axis (z), and the clamping jaw being mobile in translation relative to the bending roller along an axis perpendicular to the bending axis (z) between a position joined with said bending roller for clamping and bending a profile to be bent and a position spaced from said bending roller for introducing a profile to be bent between the latter and said clamping jaw.

Such machines have a kinematic combining relative movement of the bending roller and the clamping jaw along an axis perpendicular to the bending axis (z) and simultaneous rotation of the bending roller and the clamping jaw about the bending axis (z) in the position in which they are joined.

One particular advantage of such a kinematic is to enable the design of machines for bending profiles in two bending directions and many bending machines of this type exist at present.

On the other hand, this kinematic leads to the production of relatively complex bending heads that furthermore have a relatively large overall size.

Moreover, an additional disadvantage of such bending machines is that the bending angle is limited to 180°, or less than 180° if the end of the bent length carries an item such as a nut to enable disengagement of the profile after bending.

One solution to alleviating these drawbacks has been to design bending machines such as are described in particular in the patent applications FR2117745, EP1561522 and EP0737526 having a totally different kinematic and the bending head of which comprises:

at least two clamping forms whose axis is the bending axis (z), taking the form of discs having plane junction faces extending in planes perpendicular to said bending axis, in which are formed a rectilinear groove with a longitudinal axis perpendicular to the bending radius, having an end face for introduction of a profile (P), and a peripheral rebate profiled in continuity with the introduction face of said groove, said groove and said rebate being such that, in the joined position of the junction faces of two clamping forms, two joined grooves delimit a duct for bending a profile (P) having an end face for introducing said profile, and the joined rebates define, in continuity with said introduction face, a bending bearing surface for said profile, means for relative movement in translation of the clamping forms along the bending axis (z), adapted to move them between a spaced-apart position for introducing and removing a profile (P) and a joined position for bending said profile, and rotation drive means adapted to drive simultaneous rotation of the clamping forms in their joined position.

Such bending machines therefore have a kinematic combining relative movement of the clamping forms along the bending axis (z) and simultaneous rotation of the bending forms about that bending axis (z) in the position in which they are joined.

According to this principle, the bending head thus includes clamping forms whose axis is the bending axis (z) that are adapted to move along that axis and to turn about it.

This design significantly reduces the overall size of the bending heads and simplifies the design of said bending heads because of a kinematic having a single reference axis, namely the bending axis (z).

Moreover, in the spaced-apart position of the clamping forms, the latter totally free the plane in which the profile is situated, with the result that removing it does not give rise to any problem even if the bending angle is greater than 180°.

On the other hand, the major drawback of such bending machines is that they enable bending in only one bending direction.

BRIEF SUMMARY OF THE INVENTION

The present invention aims to alleviate this drawback and has for its main object the provision of a bending machine of the type described above, i.e. the kinematic of which has only one reference axis, adapted to bend a profile in two bending directions.

Another object of the invention is to provide a machine for bending a profile in two bending directions enabling bending angles greater than 180° to be produced. To this end, the invention is aimed at a bending machine having a bending head as described in the above preamble, characterised in that:

the clamping forms include in each of their junction faces a rectilinear second groove following with the rectilinear first groove a pair of grooves delimiting in the joined position of the junction faces of the two clamping forms two clamping ducts between the introduction faces of which extends the bending bearing surface for the profiles (P) formed by the two peripheral rebates joined, the arrangement of said grooves and rebates being such that the bending bearing surface for the profiles delimits between the introduction faces of the two clamping ducts a circular arc at least equal to 270° adapted to enable the bending of a length of profile (P):

either in a first bending direction using one of the two pairs of grooves, by rotation of the clamping forms in a first rotation direction, or in a second bending direction using the other pair of grooves, by rotation of the clamping forms in a rotation direction that is the opposite of the first rotation direction, means for relative movement of the means for holding the profile (P) and the bending head are adapted to place the axis of one or the other pair of grooves on the longitudinal axis (x).

Thus the invention consists in providing two grooves in the junction face of each clamping form, each for bending profiles in one bending direction, and a rebate, arranged so that the groove not being used for bending is "retracted" relative to the longitudinal bending axis. This solution therefore produces machines for bending in two bending directions including bending heads of identical overall size and design to those of present-day bending machines the kinematic of which has only one reference axis.

This design further enables bending angles greater than 180° to be produced, notably as a function of the required maximum value of that bending angle, the pair of grooves produced in the junction face of each clamping form is advantageously such that the rebate produced between the introduction faces of said grooves delimits a circular arc between 270° and 315° inclusive.

According to another advantageous embodiment of the invention aimed at a bending machine comprising two rules disposed on the upstream side of the clamping forms and adapted to enable the bending of a profile by each of the pairs of grooves, said rules are advantageously mounted on a single carriage associated with means for moving said carriage.

This arrangement of the rules on a single carriage constitutes a highly advantageous disposition significantly simplifying the bending machine. The movement of such rules requires only one guide and only one feed control system, instead of the two guides and two control systems required for present-day machines enabling bending in two directions.

According to another advantageous embodiment of the invention, the means for driving the clamping forms in rotation include an axial opening produced in each of said clamping forms and a rotary shaft adapted to extend in these openings, said openings and said rotary shaft having conjugate members for immobilizing them relative to each other in rotation. Moreover, in a first advantageous variant of the invention aimed at a bending machine comprising two clamping forms, one of said clamping forms, referred to as the fixed form, is fixed in translation along the bending axis (z) and the other bending form, referred to as the mobile form, is mounted on means for moving said mobile clamping form in translation along the bending axis (z).

On the subject of this first variant, the rotary shaft is furthermore advantageously carried by means for moving said rotary shaft in translation along the bending axis (z) adapted to enable it to be held engaged with the two clamping forms in each of the relative positions of said clamping forms and notably the joined and spaced apart extreme positions thereof. Moreover, in the spaced-apart position of the two clamping forms the means for moving the rotary shaft in translation along the bending axis (z) are advantageously adapted to enable the latter to be placed either in a position referred to as the deployed position in which said rotary shaft is engaged with the clamping forms or in a position called the retracted position in which said rotary shaft frees, between the two junction faces of said clamping forms, a space adapted to enable the passage of the profile in order to change the bending direction.

This disposition significantly simplifies the kinematic of movement of the profiles on changes of bending direction, because this requires only one movement along an axis orthogonal to the longitudinal axis (x).

According to a second advantageous variant of the invention aimed at a bending machine comprising three clamping forms, those three clamping forms advantageously consist in:

- a clamping form referred to as the intermediate clamping form having opposite upper and lower junction faces,
- a clamping form referred to as the upper clamping form having a junction face adapted to cooperate with the upper junction face of the intermediate clamping form, and
- a clamping form referred to as the lower clamping form having a junction face adapted to cooperate with the lower junction face of the intermediate clamping form,
- the grooves and rebates produced in the upper clamping form and the upper junction face of the intermediate clamping form having dimensions different from those of the grooves and rebates produced in the lower clamping form and the lower junction face of the intermediate clamping form to enable the bending of profiles with different sections. Moreover, this bending machine then further comprises means for relative movement of the means for holding the profile and the bending head adapted to position said profile facing one or the other pair of clamping forms.

Furthermore, in this second variant:

- one of the upper and lower bending form is advantageously fixed in translation along the bending axis (z), and
- the rotary shaft is advantageously constrained to move in translation with the other of the upper and lower clamping form and is adapted to bring the three clamping forms to their joined position against the action of spring means disposed between the respective junction faces of said clamping forms.

The invention is also directed to a tool for bending a profile about a bending axis (z), comprising at least two bending forms having junction faces in which are formed a rectilinear groove and a peripheral rebate profiled in continuity with said groove. According to the invention, the clamping forms of this tools include, formed in each of their junction faces, a rectilinear second groove foaming with the rectilinear first groove a pair of grooves delimiting in the joined position of the junction faces of the two clamping forms two clamping ducts between the introduction faces of which extends the bending bearing surface for the profiles (P) formed of the two peripheral rebates joined, the arrangement of said grooves and rebates being such that the winding bearing surface for the profiles delimits between the introduction faces of the two clamping ducts a circular arc at least equal to 270° adapted to allow the bending of a length of profile (P):

- either in a first bending direction using one of the two pairs of grooves, by rotation of the clamping forms in a first direction,
- or in a second bending direction using the other pair of grooves, by rotation of the clamping forms in a rotation direction that is the opposite of the first rotation direction.

The invention further encompasses a tool as defined hereinabove having separately or in combination any of the advantageous features stated in the text and the claims of the present application.

BRIEF DESCRIPTION OF THE DRAWINGS

Other features, aims and advantages of the invention will emerge from the following detailed description with reference to the appended drawings, which represent by way of non-limiting examples two preferred embodiments of the invention and a variant of the second embodiment. In these drawings.

DETAILED DESCRIPTION OF THE INVENTION

The bending machines of the invention represented by way of example in the figures are machines for bending in two bending directions a profile P carried by means of any type of means known in themselves, schematically represented at D, adapted to move said profile along a horizontal axis (x).

Note that, in order to simplify the detailed description given hereinafter, the bending machines are described in their usual position of use in which, in particular, the bending axis (z) is a vertical axis and the displacement axis (x) is a horizontal axis. Consequently, the terms vertical, horizontal, etc. relate to such a position.

Figure 1:
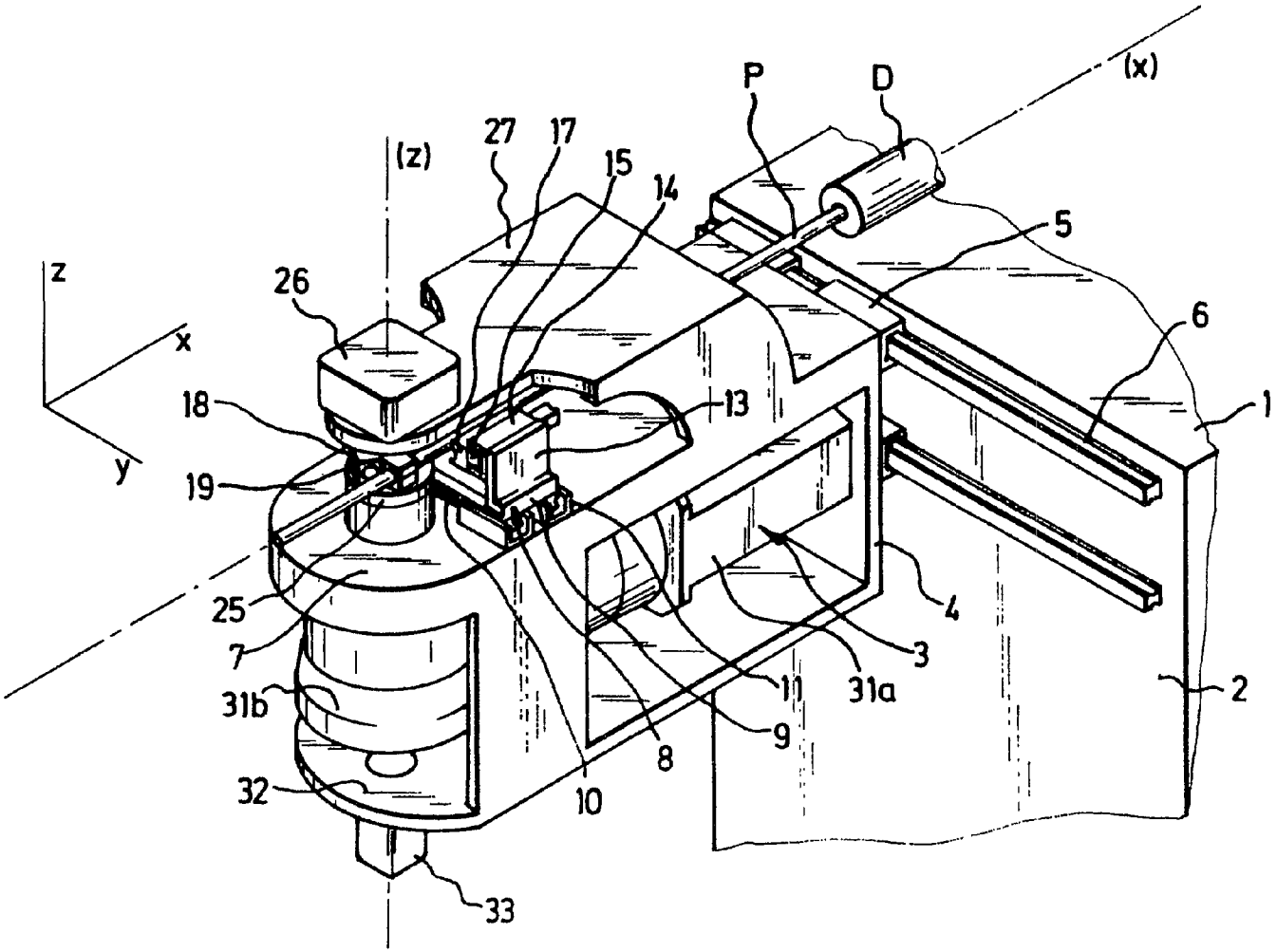
FIG. 1 is a diagrammatic perspective view of a first embodiment of a bending machine of the invention including two clamping forms.

The bending machine having two clamping forms represented in FIG. 1 comprises, firstly, a frame 1 including a vertical front plate 2.

This bending machine comprises a first carriage 3 adapted to slide horizontally along a horizontal axis Y relative to the frame 1 and including a vertical table 4 having horizontal slides such as 5 adapted to cooperate with horizontal rails such as 6 fainted on the front plate 2 of the frame 1.

This first carriage 3 additionally includes an upper horizontal table 7 on which a second carriage 8 is mounted to slide in translation on said horizontal axis Y and which has a horizontal plate 9 on the underside of which are disposed horizontal rails such as 10 adapted to slide in slides such as 11 provided on said upper table 7 of the first carriage 3.

The second carriage 8 also includes two parallel plates 12, 13 extending vertically on the horizontal plate 9 each having toward their upper end a slide 14 that extends horizontally along an axis X perpendicular to the axis Y and thus parallel to the axis (x) of movement of the profile P.

Each of these slides 14 is adapted to house a sliding rail 15 for supporting a guide rule 16, 17 of standard type, i.e. including a longitudinal bearing and guide groove for the profile to be bent.

The bending machine represented in FIG. 1 further includes a bending tool disposed in front of the second carriage 8 and adapted to cooperate with one or the other of the guide rules 16, 17 in order to enable bending in two bending directions.

This tool consists of two clamping forms 18, 19 whose axis is a vertical bending axis (z) taking the form of discs having plane junction faces 18*a*, 19*a* extending in horizontal planes (X, Y) perpendicular to said bending axis and at the periphery of which are formed two rectilinear grooves with a longitudinal axis perpendicular to the bending radius, respectively grooves 20*a*, 21*a* for the upper clamping form 18 and grooves 20*b*, 21*b* for the lower clamping form 19, between which extends a respective peripheral rebate 22*a*, 22*b*.

These grooves 20*a*, 20*b*, 21*a*, 21*b* and rebates 22*a*, 22*b* are, firstly, such that in the position with the junction faces 18*a*, 19*a* of the two clamping forms 18, 19 joined two joined grooves 20*a*-20*b*, 21*a*-21*b* delimit a clamping duct for a profile P and the joined rebates 22*a*-22*b* define a bending bearing surface for said profile.

Moreover, the arrangement of said grooves and rebate, in association with one or the other rule 16, 17, enables the bending of a length of profile P:

- either in a first bending direction using one of the two pairs of grooves 20*a*-20*b*, by rotation of the clamping forms 18, 19 in a first rotation direction,
- or in a second bending direction using the other pair of grooves 21*a*-21*b*, by rotation of the clamping forms 18, 19 in a rotation direction that is the opposite of the first rotation direction.

In the example represented, and in order to fulfil the aforementioned functions, the faces F20, F21 for introduction of the profiles P of the two grooves 20*a*, 21*a* or 20*b*, 21*b* formed on a clamping form 18 or 19 (i.e. the faces of these grooves with the rebate 22*a* or 22*b* between them), delimit between them an angle $\alpha$ equal to 270°, which can be increased up to 315°.

Each clamping form 18, 19 further includes an axial circular opening 23 in which splines 24 are formed.

These clamping forms 18, 19 are further adapted:

- to be moved relative to each other in translation along the bending axis (z) between a spaced-apart position of the junction faces 18*a*, 19*a* for introducing and removing a profile and a joined position for bending said profile, and
- to be driven simultaneously in rotation in the position with the junction faces 18*a*, 19*a* joined.

To this end, and firstly, the lower clamping form 19 is fixed in terms of movement in translation along the bending axis (z) and rests on fixed horizontal friction ring 25.

For its part, the upper clamping form 18 is mobile in terms of movement in translation along the bending axis (z) and to this end is mounted by means of a bearing 28 below the lower end of a vertically arranged rod 26*a* of an actuator 26 the body of which is fastened to a bridge 27 extending above the upper table 7 of the first carriage 3, said actuator being adapted:

- in its deployed position, to exert a clamping force holding the junction faces 18*a*, 19*a* of the clamping forms 18, 19 joined, and
- in its retracted position, to hold the two clamping forms 18, 19 in their spaced-apart position for introducing or removing a profile P or for changing the bending direction, as described hereinafter.

For their part, the means for driving the two clamping forms 18, 19 in rotation include a vertical shaft 29 that extends along the bending axis (z), is engaged in the openings 23 and has ribs 30 conjugate with the splines 24, said shaft being driven in rotation by a gearmotor 31*a*-31*b* carried by the first carriage 3 between the upper table 7 and a horizontal lower table 32 of the latter carriage.

Figure 2:
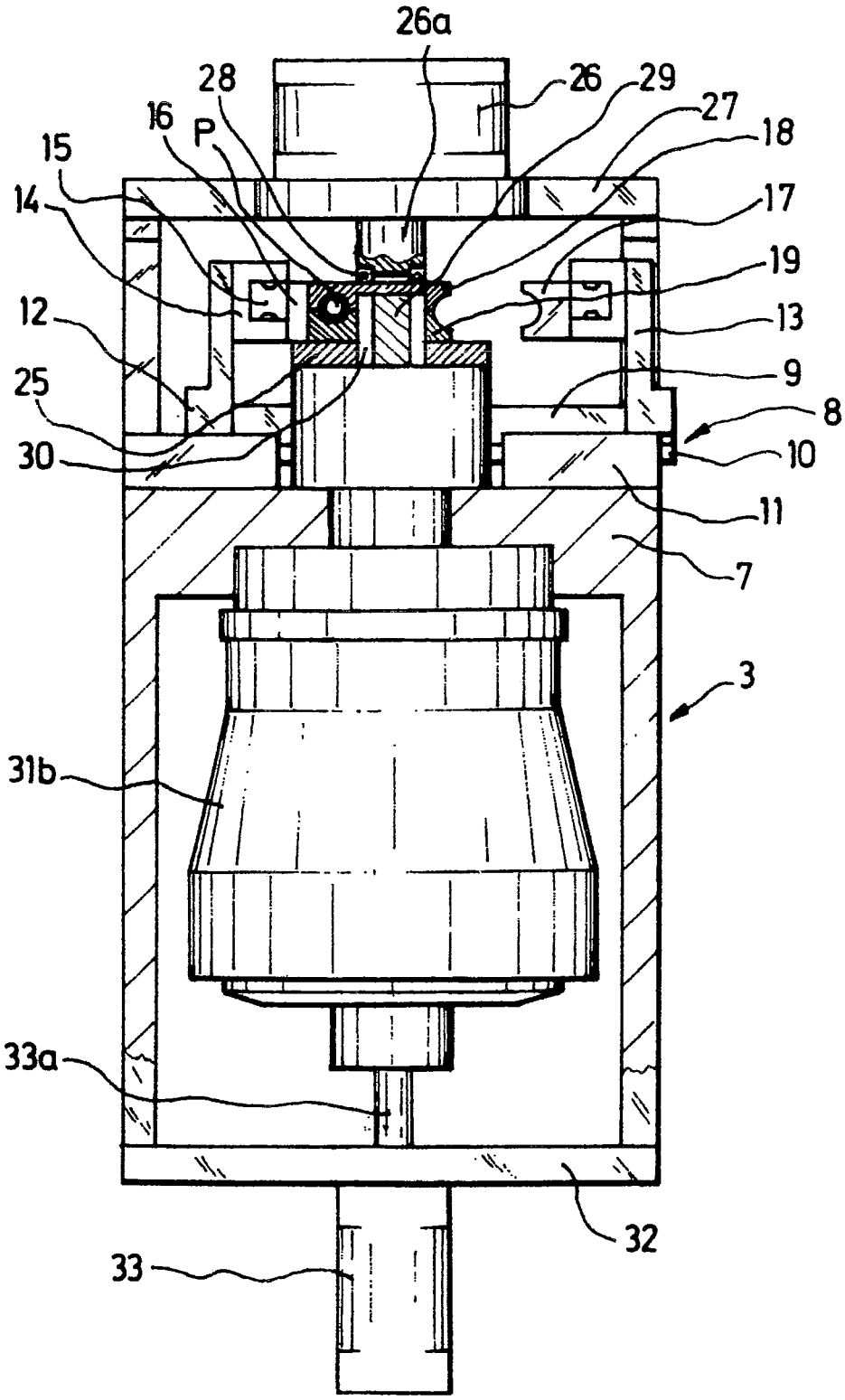
FIG. 2 is a partially cut away front view of the bending head of this first embodiment in the position with the two clamping forms joined.
Figure 3A:
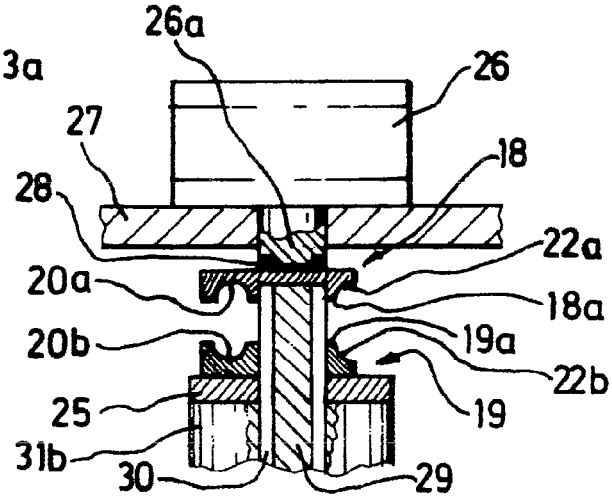
FIGS. 3*a* and 3*b* are two partial and partially cut-away front views representing two distinct states of the bending head of this first embodiment in the spaced-apart position of the two clamping forms.
Figure 3B:
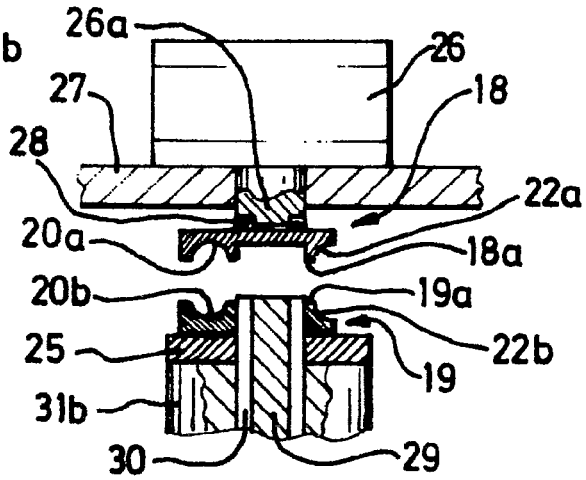
Figure 4:
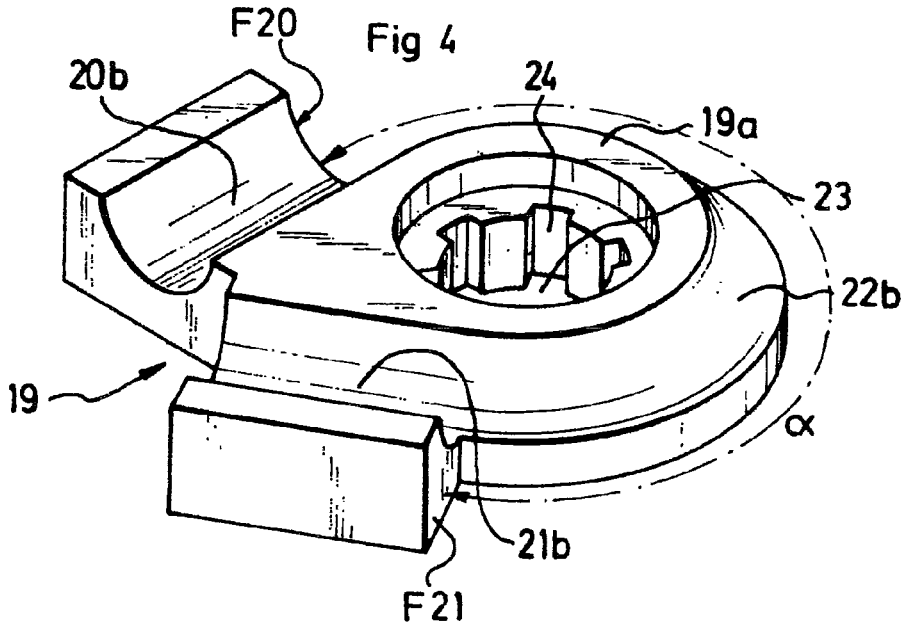
FIG. 4 is a perspective view of a clamping form of the invention.

Moreover, the rotary shaft 29 is constrained to move in translation with the vertical rod 33*a* of an actuator 33 the body of which is disposed on the lower table 32 of the first carriage 3, said actuator being adapted:

- in its deployed position, to hold the rotary shaft 29 engaged with the two clamping forms 18, 19 in each of the relative positions of said clamping forms, and notably its joined and spaced-apart extreme positions, represented in FIGS. 2 and 3*a*, and
- in its retracted position, and in the spaced-apart position of the two clamping forms 18, 19, to enable the rotary shaft 29 to be placed in a retracted position in which, as shown in FIG. 3*b*, said rotary shaft frees a space between the two junction faces 18*a*, 19*a* of said clamping forms adapted to allow the passage of the profile P for changing the bending direction. FIG. 4 is a perspective view of the first embodiment.

According to this principle, the rotary shaft 29 has the function of indexing the relative position in rotation of the two clamping forms 18, 19, at the same time as enabling, in the spaced-apart position of the clamping forms 18, 19, movement of the first carriage 3 along the axis Y for changing the direction of bending the profile P.

Figure 5:
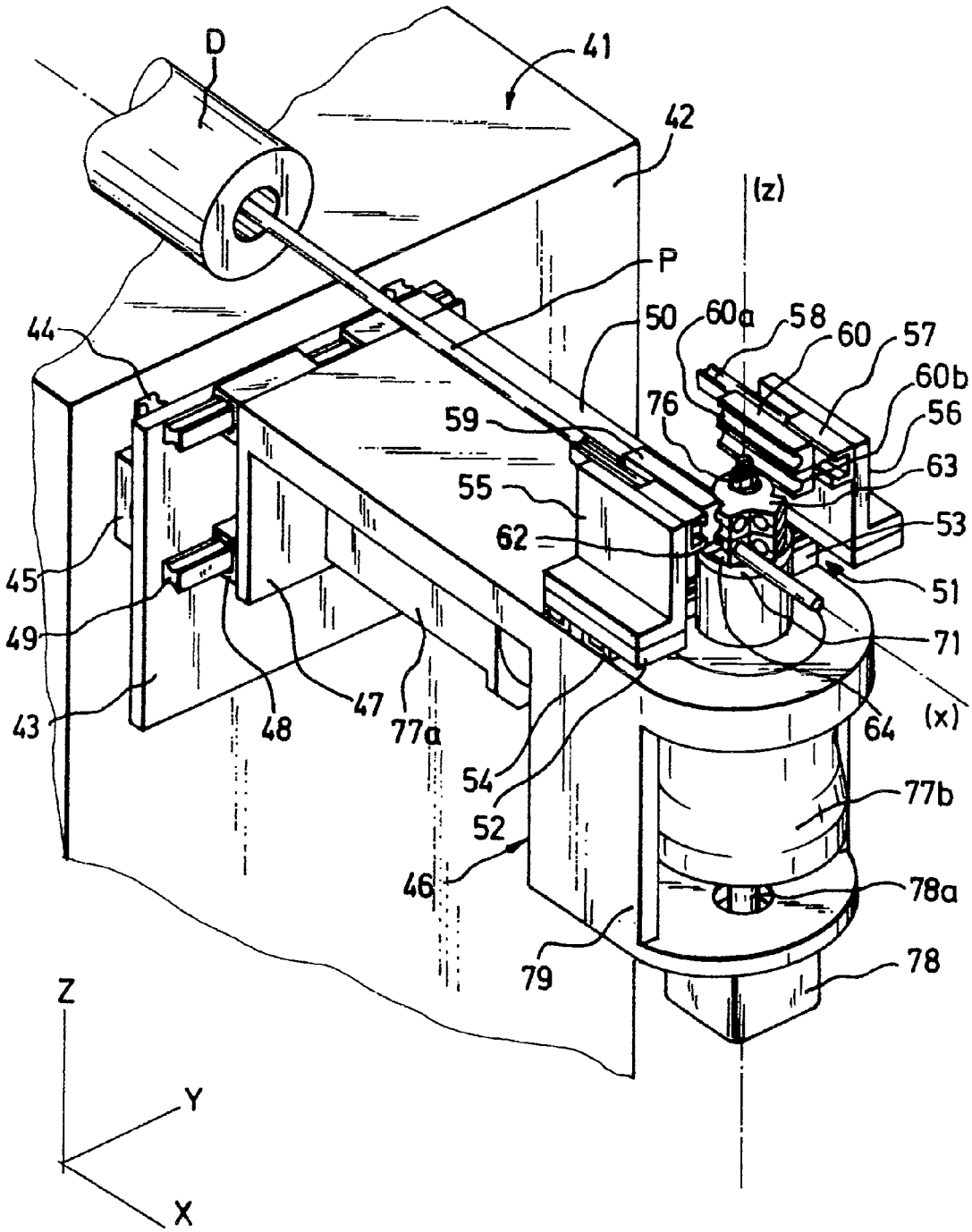
FIG. 5 is a diagrammatic perspective view of a second embodiment of a bending machine of the invention including three bending forms.
Figure 6:
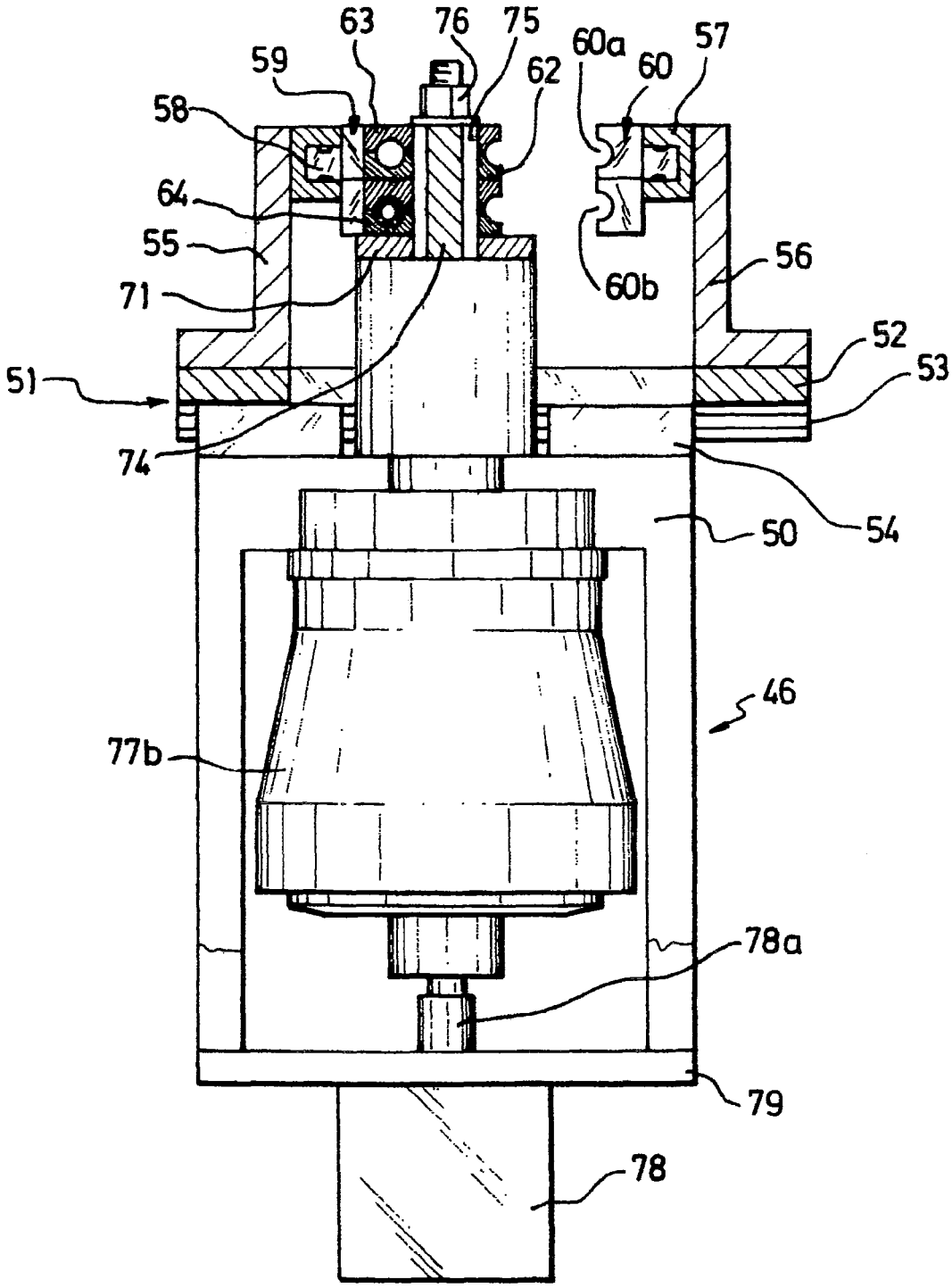
FIG. 6 is a partially cut-away front view of the bending head of this second embodiment in the position with the three clamping forms joined.
Figure 7:
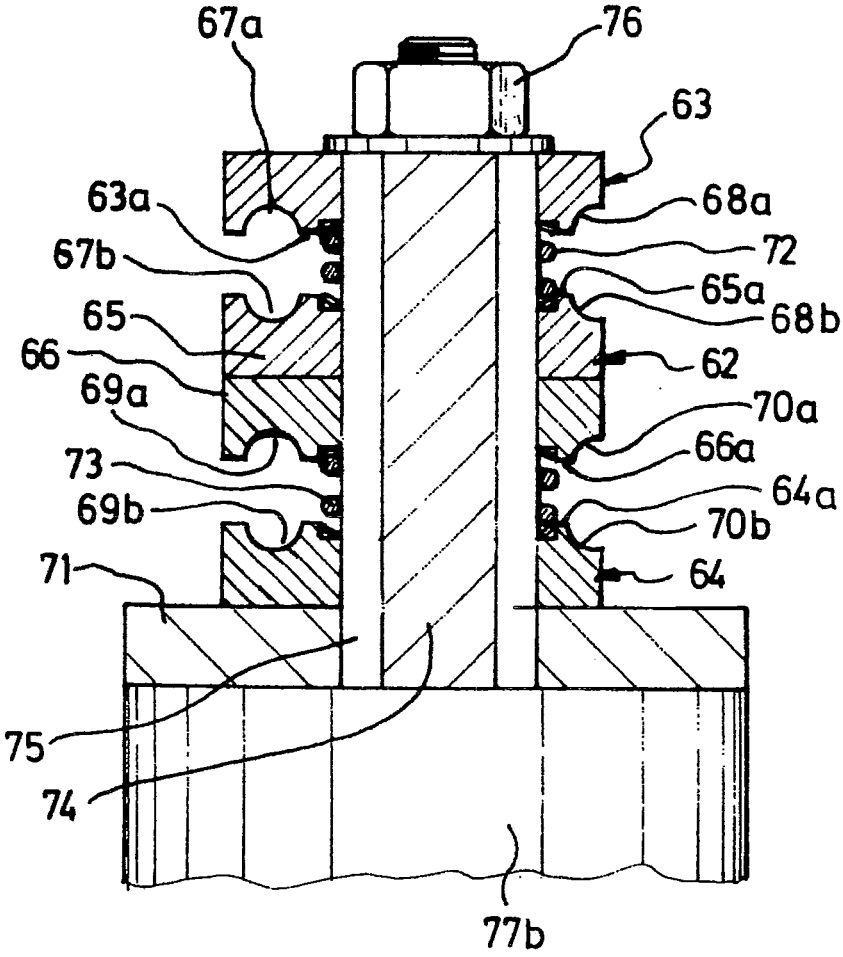
FIG. 7 is a partial and partially cut-away front view representing the bending head of this second embodiment in the spaced-apart position of the three clamping forms.

The bending machine represented in FIG. 5 has three clamping forms, adapted not only to enable bending of profiles in two bending directions but also to enable bending of two profiles P with different sections.

This bending machine comprises, firstly, a frame 41 including a vertical front plate 42. This bending machine further comprises a first carriage able to slide vertically along a vertical axis Z relative to the frame 41 and consisting of a vertical table 43 having vertical rails such as 44 adapted to slide in vertical slides such as 45 on the front plate 42 of the frame 41.

This bending machine also includes a generally stirrup-shaped second carriage 46 consisting of:

- a vertical table 47 able to slide horizontally along a vertical axis Y relative to the first carriage and to this end having horizontal slides such as 48 inside which slide horizontal rails such as 49 extending along the first carriage, and
- a horizontal upper table 50 on the front portion of which are disposed horizontal slides such as 54 extending along the axis Y.

This bending machine also comprises a third carriage 51 able to slide horizontally along the horizontal axis Y relative to the upper table 50 of the second carriage 46 and including a horizontal plate 52 on the undersurface of which are provided horizontal rails such as 53 able to slide in slides 54 provided on the upper table 50 of the second carriage 46.

This third carriage 51 also includes two parallel vertical plates 55, 56 on the horizontal plate 52, each provided toward its upper end with a slide 57 that extends horizontally along an axis X perpendicular to the axis Y and thus parallel to the axis (x) of movement of the profile P.

Each of these slides 57 is adapted to house a sliding rail 58 for supporting a guide rule 59, 60, each of said rules including two superposed grooves such as 60*a*, 60*b* with different sections adapted to house profiles with different sections.

The tool of this bending machine consists of three clamping forms 62, 63, 64 of identical design to the clamping forms 18, 19 described hereinabove, i.e. clamping forms of which each junction face has two rectilinear grooves with a longitudinal axis perpendicular to the bending radius between which extends a peripheral rebate. These clamping forms consist of:

- an intermediate clamping form 62 having two opposite junction faces: an upper junction face 65*a* and a lower junction face 66*a*,
- an upper clamping form 63 having a lower junction face 63*a* adapted to cooperate with the upper junction face 65*a* of the intermediate clamping form 62, and
- a lower clamping form 64 having an upper junction face 64*a* adapted to cooperate with the lower junction face 66*a* of the intermediate clamping form 62.

Moreover, to enable bending of profiles P with different sections, the grooves such as 67*a*, 67*b* and the rebates such as 68*a*, 68*b* formed on the junction face 63*a* of the upper clamping form 63 and the upper junction face 65*a* of the intermediate clamping form 62 have dimensions different from those of the grooves such as 69*a*, 69*b* and the rebates such as 70*a*, 70*b* provided in the junction face 64*a* of the lower clamping form 64 and the lower junction face 66*a* of the intermediate clamping form 62.

As before, these three clamping forms 62-64 are adapted:

- to move in translation relative to each other along the bending axis (z) between a spaced-apart position of the junction faces 63*a*-65*a*, 64*a*-66*a* for introducing and removing a profile P and a joined position for bending said profile, and
- to be driven in simultaneous rotation in the position with the junction faces 63*a*-65*a*, 64*a*-66*a* joined.

To this end, and firstly, the lower clamping form 64 is fixed in terms of movement in translation along the bending axis (z) and rests on a fixed horizontal friction ring 71.

Moreover, spring means such as two coil springs 72, 73 are disposed between the respective junction faces 63*a*-65*a*, 64*a*-66*a* of the clamping forms to spring-load the intermediate clamping form 62 and the upper clamping form 63 toward their spaced-apart position.

The clamping forms 62-64 are held in their joined position by means of a vertical shaft 74 that extends along the bending axis (z), is engaged in the openings 23 provided in said clamping forms and has ribs 75 conjugate with the splines 24, said shaft having:

- an upper end including a member for limiting movement in translation of the upper clamping form 63, consisting in this example of a nut 76,
- a lower end constrained to move in translation with the vertically-arranged rod 78*a* of an actuator 78 the body of which is disposed on the lower table of a stirrup-shaped part 79 connected to the upper table 50 of the second carriage 46, said actuator being adapted:
  - in its deployed position, to allow the intermediate clamping form 62 and the upper clamping form 63 to be moved toward their spaced-apart position by the springs 72, 73, and
  - in its retracted position, to exert a clamping force to hold the junction faces 63*a*-65*a*, 64*a*-66*a* of the clamping forms 62-64 joined.

Moreover, this shaft 74 is driven in rotation by a gearmotor 77*a*, 77*b* carried by the second carriage 46 under its upper table 50.

According to this principle, the rotary shaft 74 has the functions of indexing the relative position in rotation of the three clamping forms 62-64 and holding said clamping forms in their joined position against the action of the spring means 72, 73.

Note further that in this second embodiment the change of bending direction is effected by virtue of the facility for movement of the tool relative to the profile P along the axes Y and Z.

Figure 8:
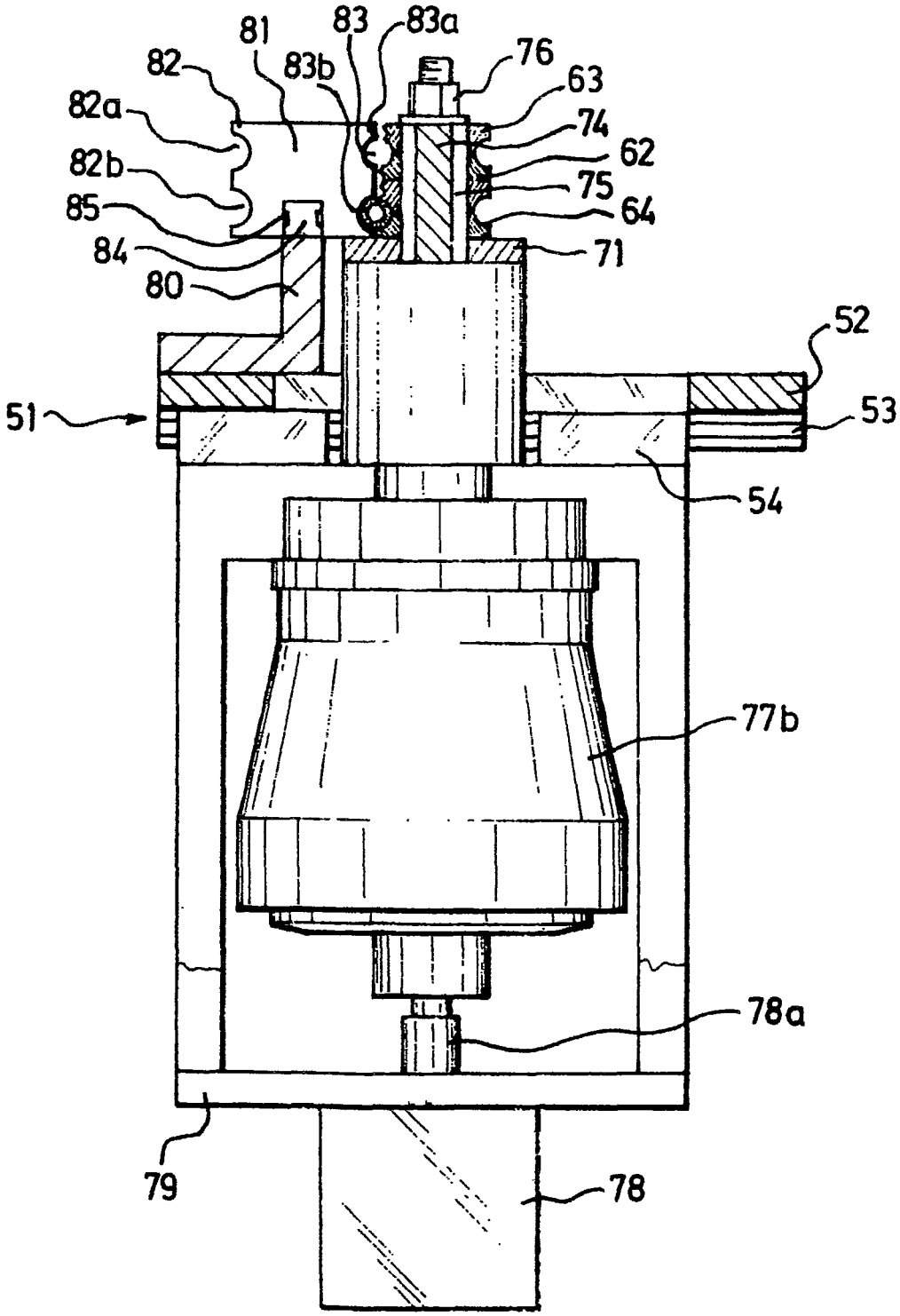
FIG. 8 is a partially cut-away front view, showing in particular the partially cut-away clamping forms, of the bending head of a variant of this second embodiment in the position with the two clamping forms joined.

FIG. 8 shows a variant of this second embodiment in which, firstly, the third carriage 51 carries a single vertical plate 80 the upper end of which forms a horizontal rail 84 extending along the axis X.

Moreover, in this variant the two rules are produced from a single rectangular parallelepiped-shaped block 81 machined to have:

- in planes parallel to the plane (X, Z), two opposite vertical faces 82, 83 in each of which are formed two superposed grooves 82*a*-82*b*, 83*a*-83*b*, respectively, with different sections, adapted to house profiles with different sections, and
- a lower face in which is produced a slide 85 adapted to house the rail 84.

In this variant, the rules 82, 83 are produced in a single block 81 carried by a single carriage 80 the movement of which requires only one guide and only one feed control system, instead of the two guides and the two control systems required for present-day machines enabling bending in two directions.

It is to be noted that this variant can also be implemented on a bending machine conforming to the first embodiment subject to providing that machine with means for moving the first carriage 3 along an axis Z.

FIGS. 9*a* to 9*d* show the operation of a bending machine as represented in FIG. 1 when bending a profile P equipped with a nut E at its end.

Figure 9A:
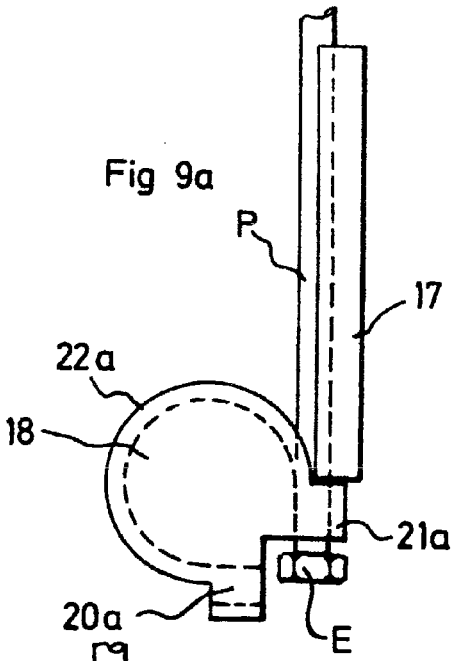
FIGS. 9*a* to 9*d* are four diagrams representing two successive bending operations carried out using the first embodiment of the bending machine according to the invention.

Firstly, the angular position of the clamping forms 18, 19 is indexed to make the axis (x) coincide with the longitudinal axis of the pair of grooves appropriate for the selected bending direction, in this example the grooves 21*a*-21*b* (see FIG. 9*a*).

Figure 9B:
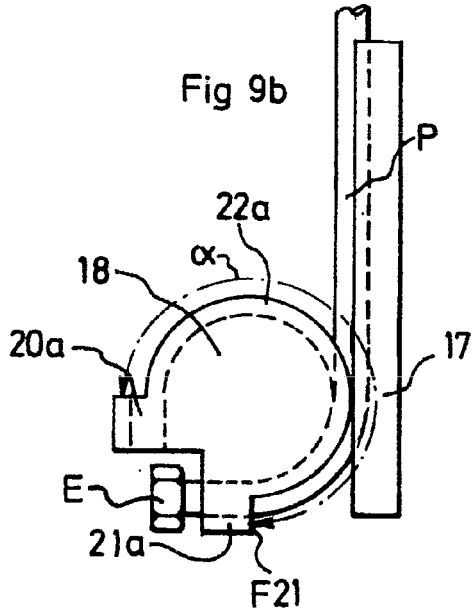

Bending is then effected, in conjunction with the corresponding rule 17, by rotating the two clamping forms 18, 19 about the bending axis (z) in the joined position of said clamping forms (see FIG. 9*b*).

Figure 9C:
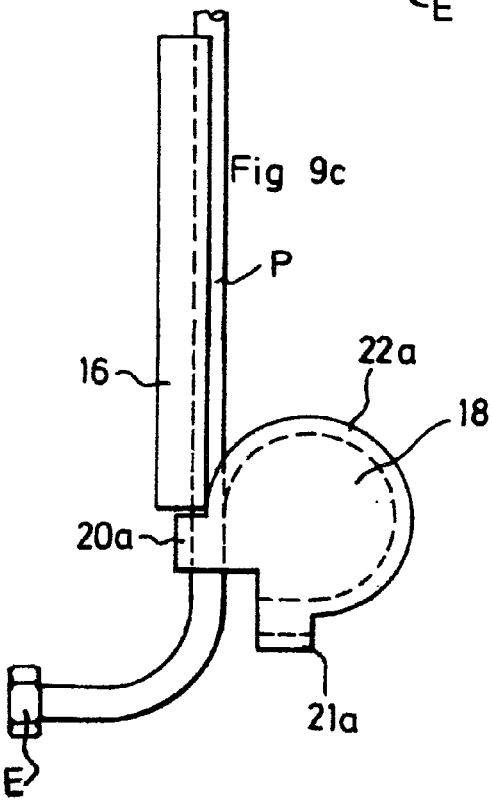
Figure 9D:
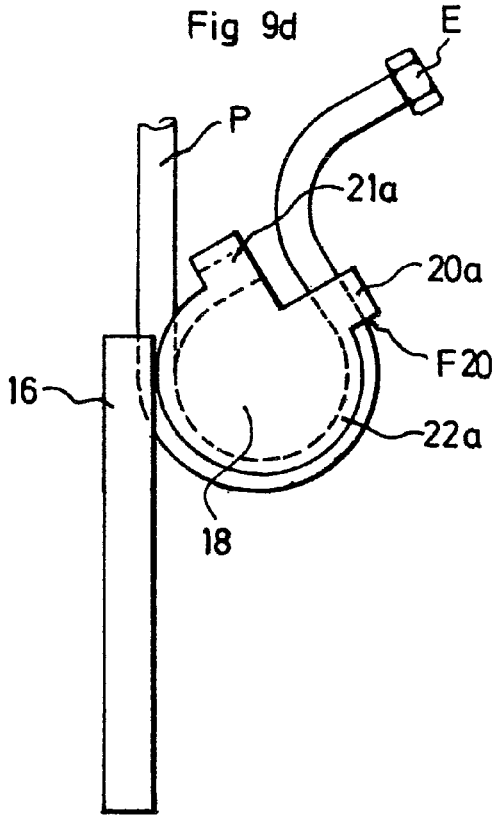

As shown in FIGS. 9*c* and 9*d*, bending in the opposite bending direction is effected in the same manner using the other pair of grooves, in this example the grooves 20*a*, 20*b*, in conjunction with the other rule 16, and, in this example, produces a bending angle greater than 180°.

This illustration highlights one of the essential advantages of the bending machine of the invention, namely the possibility of producing bending angles greater than 180° in both bending directions.

The invention claimed is:

1. Machine for bending a profile (P), including means for holding and moving (D) the profile along a longitudinal displacement axis (x) and a bending head rotatable about a bending axis (z), and further including:

at least two clamping forms whose axis is the bending axis (z), taking the form of discs having plane junction faces extending in planes perpendicular to said bending axis, in which are formed a rectilinear first groove with a longitudinal axis perpendicular to the bending radius, having an end face for introduction of a profile (P) and a peripheral rebate profiled in continuity with the introduction face of said groove, said groove and said rebate being such that, in the joined position of the junction faces of two clamping forms, two joined grooves delimit a duct for bending a profile (P) having the end face for introducing said profile, and the joined rebates define, in continuity with said introduction face, a bending bearing surface for said profile, means for relative movement in translation of the clamping forms along the bending axis (z), adapted to move them between a spaced-apart position for introducing and removing a profile (P) and a joined position for bending said profile, and rotation drive means adapted to drive simultaneous rotation of the clamping forms in their joined position, said bending machine being characterised in that:

the clamping forms have in each of their junction faces a rectilinear second groove forming with the rectilinear first groove a pair of grooves delimiting in the joined position of the junction faces of the two clamping forms two clamping ducts between the introduction faces of which extends the bending bearing surface for the profiles (P) formed by two peripheral rebates joined, the arrangement of said grooves and rebates being such that the bending bearing surface for the profiles delimits between the introduction faces of the two clamping ducts a circular arc (α) at least equal to 270° adapted to enable the bending of a length of profile (P):

either in a first bending direction using one of the two pairs of grooves, by rotation of the clamping forms in a first rotation direction, or in a second bending direction using the other pair of grooves, by rotation of the clamping forms in a rotation direction that is the opposite of the first rotation direction, means for relative movement of the means (D) for holding the profile (P) and the bending head are adapted to place the axis of one or the other pair of grooves on the longitudinal axis (x).

2. Bending machine according to claim 1, characterised in that the pair of grooves produced in the junction face of each clamping form is such that the rebate produced between the introduction faces of said grooves delimits a circular arc (α) between 270° and 315° inclusive.

3. Bending machine according to claim 2, including two rules disposed on the upstream side of the clamping forms and adapted to enable the bending of a profile (P) by each of the pairs of grooves, characterised in that said rules are mounted on a single carriage associated with means for moving said carriage.

4. Bending machine according to claim 2, characterised in that the means for driving the clamping forms in rotation include an axial opening produced in each of said clamping forms and a rotary shaft adapted to extend in these openings, said openings and said rotary shaft having conjugate members for immobilizing them relative to each other in rotation.

5. Bending machine according to claim 2, characterised in that it includes:

three clamping forms consisting of:

an intermediate clamping form having two opposite upper and lower junction faces, an upper clamping form having a junction face adapted to cooperate with the upper junction face of the intermediate clamping form, and a lower clamping form having a junction face adapted to cooperate with the lower junction face of the intermediate clamping form, the grooves and rebates produced in the upper clamping form and the upper junction face of the intermediate clamping form having dimensions different from those of the grooves and rebates produced in the lower clamping form and the lower junction face of the intermediate clamping form to enable the bending of profiles (P) with different sections, means for relative movement of the means (D) for holding the profile (P) and the bending head adapted to position said profile facing one or the other pair of clamping forms.

6. Bending machine according claim 1, including two rules disposed on the upstream side of the clamping forms and adapted to enable the bending of a profile (P) by each of the pairs of grooves, characterised in that said rules are mounted on a single carriage associated with means for moving said carriage.

7. Bending machine according to claim 6, characterised in that the means for driving the clamping forms in rotation include an axial opening produced in each of said clamping forms and a rotary shaft adapted to extend in these openings, said openings and said rotary shaft having conjugate members for immobilizing them relative to each other in rotation.

8. Bending machine according to claim 6, characterised in that it includes:

three clamping forms consisting of:

an intermediate clamping form having two opposite upper and lower junction faces, an upper clamping form having a junction face adapted to cooperate with the upper junction face of the intermediate clamping form, and a lower clamping form having a junction face adapted to cooperate with the lower junction face of the intermediate clamping form, the grooves and rebates produced in the upper clamping form and the upper junction face of the intermediate clamping form having dimensions different from those of the grooves and rebates produced in the lower clamping form and the lower junction face of the intermediate clamping form to enable the bending of profiles (P) with different sections, means for relative movement of the means (D) for holding the profile (P) and the bending head adapted to position said profile facing one or the other pair of clamping forms.

9. Bending machine according to claim 1, characterised in that the means for driving the clamping forms in rotation include an axial opening produced in each of said clamping forms and a rotary shaft adapted to extend in these openings, said openings and said rotary shaft having conjugate members for immobilizing them relative to each other in rotation.

10. Bending machine according to claim 9, characterised in that it includes:

three clamping forms consisting of:

an intermediate clamping form having two opposite upper and lower junction faces, an upper clamping form having a junction face adapted to cooperate with the upper junction face of the intermediate clamping form, and a lower clamping form having a junction face adapted to cooperate with the lower junction face of the intermediate clamping form, the grooves and rebates produced in the upper clamping form and the upper junction face of the intermediate clamping form having dimensions different from those of the grooves and rebates produced in the lower clamping form and the lower junction face of the intermediate clamping form to enable the bending of profiles (P) with different sections, means for relative movement of the means (D) for holding the profile (P) and the bending head adapted to position said profile facing one or the other pair of clamping forms.

11. Bending machine according to claim 9, including two clamping forms, characterised in that one of said clamping forms is fixed in translation along the bending axis (z) and in that the other clamping form is mounted on means for moving said other clamping form in translation along the bending axis (z).

12. Bending machine according to claim 11, characterised in that the rotary shaft is carried by means for moving said rotary shaft in translation along the bending axis (z) adapted to enable it to be held engaged with the two clamping forms in each of the relative positions of said clamping forms and notably the joined and spaced-apart extreme positions thereof.

13. Bending machine according to claim 12, characterised in that in the spaced-apart position of the two clamping forms the means for moving the rotary shaft in translation along the bending axis (z) enable the rotary shaft to be placed either in a deployed position in which said rotary shaft is engaged with the clamping forms or in a retracted position in which said rotary shaft frees, between the two junction faces of said clamping forms, a space adapted to enable the passage of the profile (P) in order to change the bending direction.

14. Bending machine according to claim 1, characterised in that it includes:

three clamping forms consisting of:

an intermediate clamping form having two opposite upper and lower junction faces, an upper clamping form having a junction face adapted to cooperate with the upper junction face of the intermediate clamping form, and a lower clamping form having a junction face adapted to cooperate with the lower junction face of the intermediate clamping form, the grooves and rebates produced in the upper clamping form and the upper junction face of the intermediate clamping form having dimensions different from those of the grooves and rebates produced in the lower clamping form and the lower junction face of the intermediate clamping form to enable the bending of profiles (P) with different sections, means for relative movement of the means (D) for holding the profile (P) and the bending head adapted to position said profile facing one or the other pair of clamping forms.

15. Bending machine according to claim 14, characterised in that:

one of the upper and lower clamping forms is fixed in translation along the bending axis (z), and the rotary shaft is constrained to move in translation the other of the upper and lower clamping forms and is adapted to bring the three clamping forms to their joined position against the action of spring means disposed between the respective junction faces of said clamping forms.

16. Tool for bending a profile about a bending axis (z), including at least two clamping forms whose axis is the bending axis (z) taking the form of discs having plane junction faces extending in planes perpendicular to said bending axis in which are formed a rectilinear groove having a longitudinal axis perpendicular to the bending radius and an end face for introducing a profile (P), a peripheral rebate profiled in continuity with the introduction face of said groove, said groove and said rebate being such that, in the joined position of the junction faces of the two clamping forms, two joined grooves delimit a bending duct for a profile (P) having an end face for introducing said profile, and the joined rebates define in continuity with said introduction face a winding bearing surface for said profile, said tool being characterised in that the clamping forms include, formed in each of their junction faces, a rectilinear second groove forming with the rectilinear first groove a pair of grooves delimiting in the joined position of the junction faces of the two clamping forms two clamping ducts between the introduction faces of which extends the winding bearing surface for the profiles (P) formed of the two peripheral rebates joined, the arrangement of said grooves and rebates being such that the winding bearing surface of the profiles delimits between the introduction faces of the two clamping ducts a circular arc ($\alpha$) at least equal to 270° adapted to allow the bending of a length of profile (P):

either in a first bending direction using one of the two pairs of grooves, by rotation of the clamping forms in a first direction, or in a second bending direction using the other pair of grooves, by rotation of the clamping forms in a rotation direction that is the opposite of the first rotation direction.

* * * * *